US006536445B2

(12) United States Patent
Kuroda

(10) Patent No.: US 6,536,445 B2
(45) Date of Patent: Mar. 25, 2003

(54) ROD MEMBER FOR AN EYELASH PERM

(75) Inventor: Ryoji Kuroda, 7th Fl., Second Torikatsu Bldg., 5-2-4, Roppongi, Minato-ku, Tokyo 106-0032 (JP)

(73) Assignee: Ryoji Kuroda, Tokyo (JP)

( * ) Notice: Subject to any disclaimer, the term of this patent is extended or adjusted under 35 U.S.C. 154(b) by 0 days.

(21) Appl. No.: 09/923,442

(22) Filed: Aug. 8, 2001

(65) Prior Publication Data

US 2002/0020423 A1 Feb. 21, 2002

(30) Foreign Application Priority Data

Aug. 21, 2000 (JP) ..... 2000-250012

(51) Int. Cl.[7] ..... A45D 2/48; A45D 40/30
(52) U.S. Cl. ..... 132/217; 132/216
(58) Field of Search ..... 132/216, 217, 132/218, 320; D28/35, 36, 55

(56) References Cited

U.S. PATENT DOCUMENTS 1,532,238 A * 4/1925 Farrell ..... 132/217
1,692,341 A * 11/1928 Locke ..... 132/217
1,836,710 A * 12/1931 Grabowski ..... 132/217
1,897,719 A * 2/1933 Birk ..... 132/217
2,079,256 A * 5/1937 Kaiser ..... 132/217

FOREIGN PATENT DOCUMENTS

JP 59-87701 6/1984

* cited by examiner

*Primary Examiner*—John J. Wilson
*Assistant Examiner*—Robyn Kieu Doan
(74) *Attorney, Agent, or Firm*—Wenderoth, Lind & Ponack, L.L.P.

(57) ABSTRACT

There is provided a rod member for an eyelash perm capable of applying a permanent to the entirety of the eyelashes and capable of performing the process of applying the permanent easily without an experienced person. The rod member for the eyelash perm comprises a plate-shaped base portion made from a soft resin and a rod portion made from a soft resin and formed to one edge of the base portion. The rod portion is formed so as to project to a front surface side of the base portion in a shape of a cross section of a substantial semi-circle and extends along the one side of the base portion. The front side surface of the base portion is an eyelashes fixing surface for eyelashes to cross over the rod portion and be fixed to by means of an appropriate adhesive material; and the back surface of the base portion is an eyelid adhering surface for an eyelid to be adhered to by means of an appropriate adhesive material.

4 Claims, 3 Drawing Sheets

ROD MEMBER FOR AN EYELASH PERM

BACKGROUND OF THE INVENTION

1. Field of the Invention

The present invention relates to a rod member for an eyelash perm for use when a permanent is to be applied to eyelashes.

2. Description of the Related Art

Particularly in makeup for women, in order to make the features of the face more clear it is important to make the eyes appear large to people. In order to do this it is effective to make the eyelashes go in an upward direction, and conventionally, an eyelash curler is generally used to make the eyelashes face upwards, making the eyes appear large. Note, however, that the eyelash curler mentioned above merely puts a crease or wrinkle into the eyelashes; therefore, as time passes the eyelashes return to their original condition and it is necessary for a person to fix the eyelashes a number of times in one day. Thus, in recent years a practice has developed of applying to the eyelashes the kind of permanent that is applied to the hair on one's head.

Conventionally, for the rod that is used to apply the permanent to the eyelashes a rod is used having a construction as shown in FIG. 6 and FIG. 7, in which an adhesive layer 2 is applied to the outer periphery of a rod member 1 having a small diameter, as disclosed in Japanese Utility Model Application Laid-open No. Sho 59-87701 (Japanese Utility Model Application No. Sho 57-181829). The rod member 1 of this rod is fixed adhesively to an eyelid 3 along the hairline of the eyelashes, and then the eyelashes are fixed adhesively to this rod member 1.

However, in the rod disclosed in the publication described above there were a number of problems such follow below.

Namely, since the rod is the rod member 1 having a small diameter, the surface area across which it touches the eyelid 3 is small; therefore, it is difficult to fix it in a stable fashion to the eyelid 3 along the hairline of the eyelashes, and also, it is difficult to secure stability during the process of applying the permanent. Further, that was a problem that unless a sufficiently experienced person applies the permanent liquid there was a risk of the permanent liquid dripping down to the eyelid 3. Further, there was a problem that the thickness of the rod member 1 is constant, so adaptation cannot be made to shorter eyelashes particularly at the inner canthus and the outer canthus, thus making it difficult to adhesively fix the rod member 1 to these shorter eyelashes, which causes instances in which it is difficult to achieve a well-balanced curve running from the inner canthus to the outer canthus. Additionally, there was also a problem of cases where if there is a sag in the eyelid 3, when the rod member 1 is fixed to the eyelid 3, there are instances when a part of the rod member 1 gets buried in the skin of the eyelid 3, and as a result, the portion of the rod member 1 receiving the eyelashes becomes smaller, and the portion of the eyelashes getting curled becomes smaller.

Further, in recent years it has been fashionable to dye the hair of the head in various colors and dye the eyebrows and eyelashes so as to match the hair of the head. However, in the case where the rod described above is used to apply the permanent, after applying the permanent the rod has to be removed before the eyelashes can be dyed.

SUMMARY OF THE INVENTION

The present invention has been made in view of the above circumstances. Therefore, a primary object of the present invention is to provide a rod for an eyelash perm in which a permanent can be applied to the entirety of the eyelashes, the procedures at the time of applying the permanent are easy and do not require an experienced person, and additionally, it is possible to apply the permanent in a stable state. A secondary object of the invention is to provide a rod for an eyelash perm capable of dying the eyelashes after applying the permanent.

In order to solve the above-mentioned problems, according to a first aspect of the present invention, a rod member for an eyelash perm is characterized in that:

- the rod member comprises a soft resin and comprises a plate-shaped base portion and a rod portion formed to one edge of the base portion; and,
- the rod portion formed to the one edge of the base portion projects to a front surface side of the base portion in a shape of a cross section of a substantial semi-circle, and extends along the one side of the base portion;
- the front side surface of the base portion is an eyelashes fixing surface for eyelashes to cross over the rod portion and be fixed to by means of an appropriate adhesive material; and
- the back surface of the base portion is an eyelid adhering surface for an eyelid to be adhered to by means of an appropriate adhesive material.

According to the structure, the base portion is plate-shaped and the eyelid adhering surface, which is the back surface of the base portion, is adhered to the eyelid by means of an appropriate adhesive material; therefore the contact surface area with the eyelid is large, so the fixing thereof to the eyelid can be performed easily and in a stable state, and also, the stability can be secured while performing the application of the permanent. Further, the base portion can effectively prevent the permanent liquid from dripping down to the eyelid. Further, even in the case where there is a sag in the eyelid there is no risk of the base portion being buried skin. Also, for the fixing of the eyelid, the eyelashes cross over the rod member and the tips thereof are fixed to the eyelashes fixing surface by means of an appropriate adhesive material; therefore, this procedure can be performed easily and in a secure fashion. Further, in the case where the eyelashes are to be dyed after the applying of the permanent, the adhesive material fixing the eyelashes to the eyelashes fixing surface is removed, and the eyelashes can be dyed while the eyelid is still fixed to the rod member for the eyelash perm, and by dying the eyelashes in this state, the base portion can effectively prevent the dye from dripping down to the eyelid.

According to a second aspect of the present invention, in the first aspect of the invention, the rod member for the eyelash perm is characterized in that the thicknesses of both end portions of the rod member extending laterally are thinner than the thickness of a middle portion of the rod member.

According to the structure, even relatively short eyelashes at the inner canthus and the outer canthus can be made to cross over the rod portion and the tip ends thereof can be fixed, and a well-balanced curl running from the inner canthus to the outer canthus can be achieved.

According to a third aspect of the present invention, in the first or the second aspect of the invention, the rod member for the eyelash perm is characterized in that the rod member, the eyelashes fixing surface, and the eyelid adhering surface are all formed in a curved fashion.

According to the structure, it is possible to fit the member easily onto an eyelid, which is three-dimensionally rising, and the fixing can be performed in a stable state.

DETAILED DESCRIPTION OF THE PREFERRED EMBODIMENTS

Hereinafter, explanation will be made of an embodiment of the present invention, making reference to the drawings.

Figure 1:
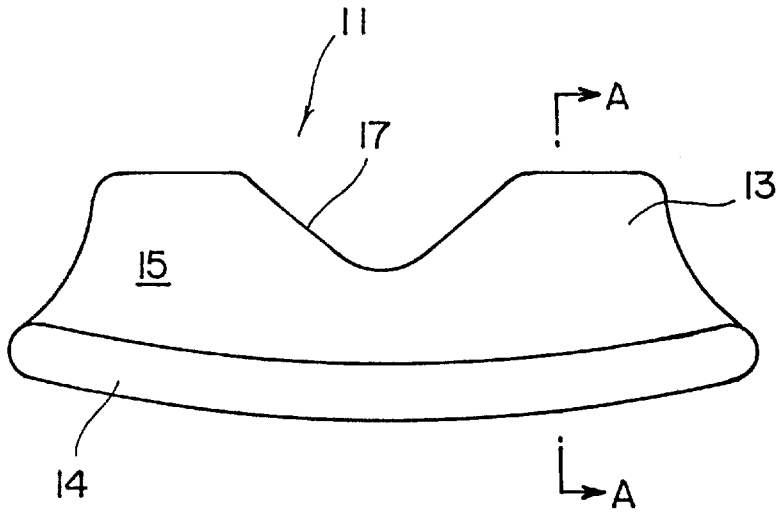
FIG. 1 is a plan view showing one example of an embodiment of a rod member for an eyelash perm according to the present invention.
Figure 2:
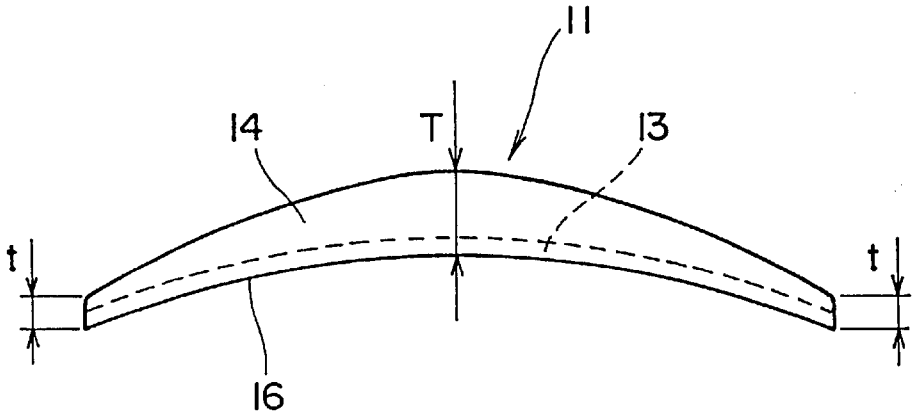
FIG. 2 is a top view of the rod member for the eyelash perm shown in FIG. 1.

FIG. 1 is a plan view showing one example of an embodiment of a rod member for an eyelash perm according to the present invention; FIG. 2 is a top view of the rod member for the eyelash perm depicted in FIG. 1; and FIG. 3 is a cross-sectional view taken along a line A—A of FIG. 1.

Figure 3:
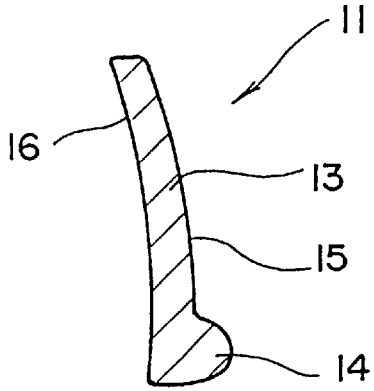
FIG. 3 is a cross-sectional view taken along a line A—A of the rod member for the eyelash perm shown in FIG. 1.

In FIG. 1 through FIG. 3, reference numeral 11 is the rod member for the eyelash perm used when the permanent is applied to the eyelashes, and this rod member for the eyelash perm 11 is made of a soft resin (i.e., including natural or synthetic resins), and is constructed of a plate base portion 13 and a rod portion 14 formed to an edge of one side of the base portion 13.

The base portion 13 is formed in substantially a rectangular shape, and its front surface is an eyelashes fixing surface 15 and its back surface is an eyelid adhering surface 16. The size of the base portion 13 is a size adapted to the size of the eyelid. Also, an edge of the longer side of the rectangularly shaped base portion 13 is formed in a shape and length so as to go along the hairline of the eyelashes. Further, at a middle portion of the other edge of the longer side of base portion 13 there is formed a V-shaped notched portion 17 so as to facilitate the curving of the base portion 13.

Further, the eyelashes fixing surface 15 and the eyelid adhering surface 16 constructed of the front surface and rear surface of the base portion 13 are parallel to each other. Also, in order to be able to go along the bulge of the eyelid more easily, the eyelid adhering surface 16 is curved in a concave shape and the eyelashes fixing surface 15 is curved in a convex shape.

Note that in the present example, as described above, there is the notched portion 17 formed to a middle portion of the other edge of the longer side; however, it is not necessarily essential to form the notched portion 17. Also, the base portion 13 is formed in a curved shape; but it is not necessarily essential to form this in a curved shape.

The rod portion 14 is formed so as to extend along one edge of the long side of the base portion 13. This rod portion 14 is formed to the eyelashes fixing surface 15 in a shape projecting as a cross-section of a substantially semi-circular shape. Further, the rod portion 14 is formed so that the thickness t of the two tips of the extending directions is thinner than the thickness T of the middle portion ($t<T$).

Figure 4:
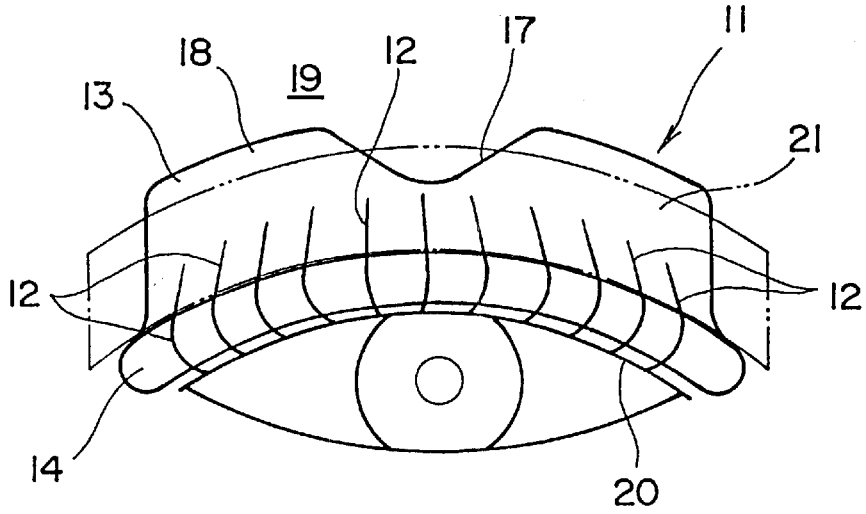
FIG. 4 is a view for explaining usage of the rod member for the eyelash perm, viewed from a front of a face.
Figure 5:
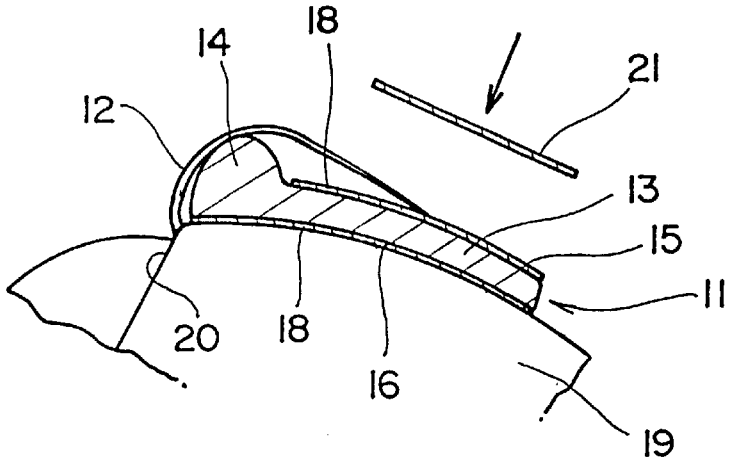
FIG. 5 is a partial cross-sectional view for explaining the usage of the rod member, viewed from a side of the face.
Figure 6:
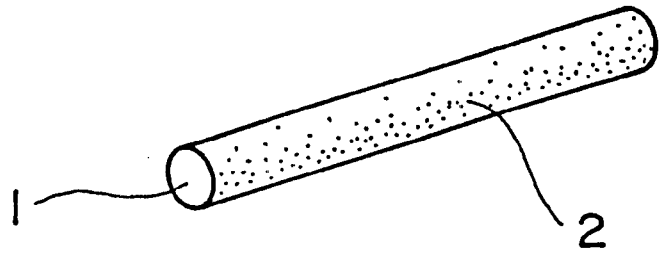
FIG. 6 (PRIOR ART)
FIG. 6 is a perspective view of a conventional rod member for an eyelash perm.
Figure 7:
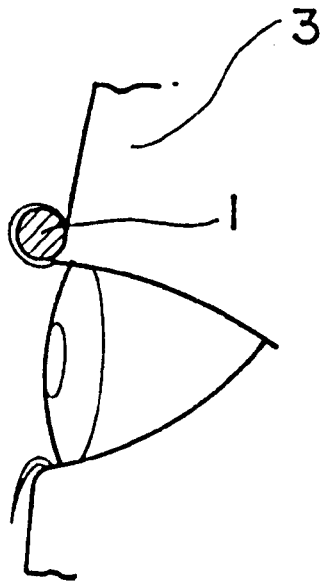
FIG. 7 (PRIOR ART)
FIG. 7 is a partial cross-sectional view for explaining the usage of the rod member of FIG. 6, viewed from a side of a face.

Having the above construction, the rod member for the eyelash perm 11 is used as depicted in FIG. 4 and FIG. 5.

When the permanent is to be applied, first, an adhesive material 18, 18 such as double-sided tape or glue is applied to the eyelashes fixing surface 15 and the eyelid adhering surface 16 of the rod member for the eyelash perm 11, and this is then adhered and fixed to the eyelid 19. At this time the rod member 14 is fixed along the hairline of the eyelashes 12. Since the base portion 13 and the rod member 14 are made of soft resin, at the time of the fixing operation is performed they can easily be adapted to the bulge of the eyelid 19 and fixed thereto in a stable and secure fashion. In the present example there is the notched portion 17 formed to the middle portion of the other edge of the long side of the base portion 13, and further, the base portion 13 is formed in a curved shape; therefore, it can be fixed along the bulge of the eyelid 19 more easily, and the rod member for the eyelash perm 11 can be fixed in a more stable and reliable manner. Further, even in the case where there is a sag in the eyelid 19, there is no risk of being buried in the skin of the eyelid 19 at this time since the base portion 13 is formed in a plate shape.

Next, the eyelashes 12 are pushed up so as to cross over the rod portion 14, and the tip edge thereof is adhered and fixed to the adhesive material 18 which has been applied to the eyelashes fixing surface 15. Then, a tape-form adhesive material 21 is adhered to the eyelashes fixing surface 15 so as to pinch the tips of each of the eyelashes 12. At this time, according to the present example, since the thickness t of the two tip portions in the directions to which the rod portion 14 extends is thinner than the thickness T of the middle portion ($t<T$), even the relatively short eyelashes 12 at the inner canthus and outer canthus can be made to cross over the rod portion 14, and the tips of the short eyelashes 12 can be fixed easily and in a secure fashion.

Permanent liquid is then applied from the tip of the rod portion 14 to the side of the base portion 13. This enables the permanent to be applied to the entirety of the eyelashes 12. Further, even if the permanent liquid drips down when it is applied it is received into the base portion 13; therefore, the eyelid 19 can be protected from the permanent liquid. The base portion 13 is shaped as a plate as described above, and the contact surface area with the eyelid 19 is large; therefore, the base portion 13 can be fixed to the eyelid 19 easily and in a stable fashion, and also it is possible to secure stability during the procedure of applying the permanent, so the procedure of applying the permanent can be performed easily.

Further, in the case where the eyelashes 12 are to be dyed after applying the permanent, the adhesive materials 18, 21 which are fixed to the eyelashes fixing surface 15 can be removed, and the eyelashes 12 can be dyed while keeping the rod member for the eyelash perm 11 fixed to the eyelid 19. By performing the dying in this state, the base portion 13 effectively prevents the dye from dripping down to the eyelid 19.

Of course, the present invention can be altered and reduced to practice in a variety of ways without changing the essential points of the present invention.

As explained above, according to the rod member for the eyelash perm according to the first aspect of the invention, the base portion is plate-shaped and the eyelid-adhering surface, which is the back side of the base portion, is adhered to the eyelid by means of an appropriate adhesive material, so the contact surface area with the eyelid is large; therefore, the fixing to the eyelid can be performed easily and in a stable state, and also, stability can be secured during the process of applying the permanent. Further, the base portion can effectively prevent the permanent liquid from dripping down to the eyelid. Further, even in the case where there is a sag in the eyelid there is no risk of the base portion being buried in the skin of the eyelid. Additionally, the tips of the eyelashes are made to cross over the rod portion and are fixed to the eyelashes fixing surface by means of an appropriate adhesive; therefore, the procedure can be performed easily and securely. Also, in the case where the eyelashes are to be dyed after the applying of the permanent, the adhesive material fixing the eyelashes to the eyelashes fixing surface can be removed, and the dying can be performed in the state in which the rod member for the eyelash perm is fixed to the eyelid, and by performing the dying in this state the base portion can effectively prevent the dye from dripping down.

According to the rod member for the eyelash perm according to the second aspect of the invention, even relatively short eyelashes at the inner canthus and the outer canthus can be made to cross over the rod portion and the tip ends thereof can be fixed, and a well-balanced curl running from the inner canthus to the outer canthus can be achieved.

According to the rod member for the eyelash perm according to the third aspect of the invention, it is possible to fit the rod member easily onto an eyelid, which is three-dimensionally rising, and the fixing thereof can be performed in a stable state.

What is claimed is:

1. A rod member for an eyelash perm comprising a soft resin, the rod member comprising a plate-shaped base portion and a rod portion formed to one edge of the base portion, wherein:

the rod portion formed to the one edge of the base portion projects to a front surface side of the base portion in a shape of a cross section of a substantial semi-circle, and extends along the one side of the base portion;

the front side surface of the base portion is an eyelashes fixing surface for eyelashes to cross over the rod portion and be fixed to by means of an appropriate adhesive material; and the back surface of the base portion is an eyelid adhering surface for an eyelid to be adhered to by means of an appropriate adhesive material.

2. A rod member for an eyelash perm according to claim 1, wherein the thicknesses of both end portions of the rod member extending laterally are thinner than the thickness of a middle portion of the rod member.

3. A rod member for an eyelash perm according to claim 1, wherein the rod member, the eyelashes fixing surface and the eyelid adhering surface are all formed in a curved fashion.

4. A rod member for an eyelash perm according to claim 2, wherein the rod member, the eyelashes fixing surface and the eyelid adhering surface are all formed in a curved fashion.

* * * * *